United States Patent [19]

Hosoe

[11] Patent Number: 4,606,161

[45] Date of Patent: Aug. 19, 1986

[54] TUBULAR ELEMENTS AND JOINTS FOR THEIR MUTUAL ARTICULATED CONNECTION TO FORM A PARTITION WALL OF VARIABLE SHAPE

[75] Inventor: Isao Hosoe, Milan, Italy

[73] Assignee: Sacea S.a.s. di Tirinnanzi Giampietro & C., Italy

[21] Appl. No.: 732,586

[22] Filed: May 10, 1985

[30] Foreign Application Priority Data

Jun. 1, 1984 [IT] Italy ..... 21995/84[U]

[51] Int. Cl.[4] ..... E04B 2/74

[52] U.S. Cl. ..... 52/239; 52/578; 52/582; 160/351

[58] Field of Search ..... 52/239, 36, 586, 578, 52/581, 582, 595; 160/351, 229 R; 405/284, 285

[56] References Cited

U.S. PATENT DOCUMENTS

| | | | |
|---|---|---|---|
| 2,869,182 | 1/1959 | White | 52/578 |
| 2,942,453 | 6/1960 | Kawl | 52/582 X |
| 3,428,108 | 2/1969 | Singer | 160/351 X |
| 3,842,555 | 10/1974 | Korell | 52/582 X |
| 4,121,645 | 10/1978 | Behr | 160/351 X |
| 4,250,676 | 2/1981 | Presby | 52/239 X |
| 4,532,747 | 8/1985 | Koetje | 52/586 |

*Primary Examiner*—J. Karl Bell

[57] ABSTRACT

A self-supporting wall is formed by assembling tubular elements with a longitudinal portion having a concave arc-shaped cross-section by means of joints being link plates of two different types. One type, with a central raised portion and two bored pins, and the other, with a lower spacer member and two dead-end hole pins, alternately link together the elements placed side by side, through plug members adapted to fit into a central passage of each element and to be coupled to said pins of the plates. The partition wall can thus assume a variety of polygonal or arc-shaped patterns with no need of being anchored to the floor or to the ceiling.

8 Claims, 10 Drawing Figures

Fig. 3
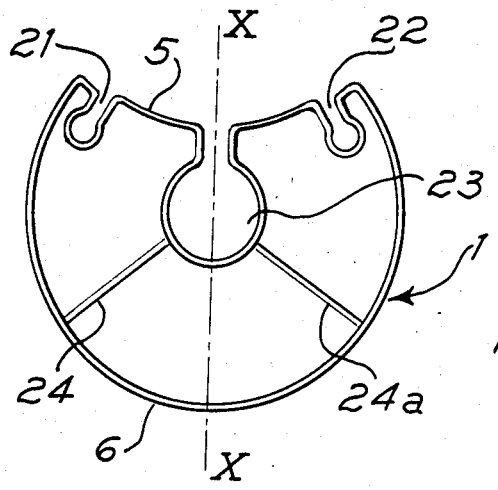
Fig. 4a
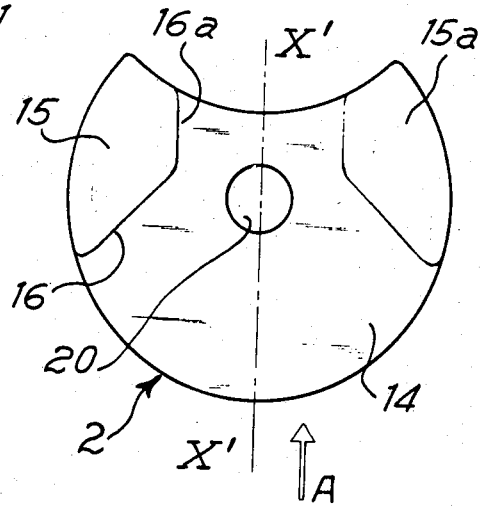
Fig. 4b
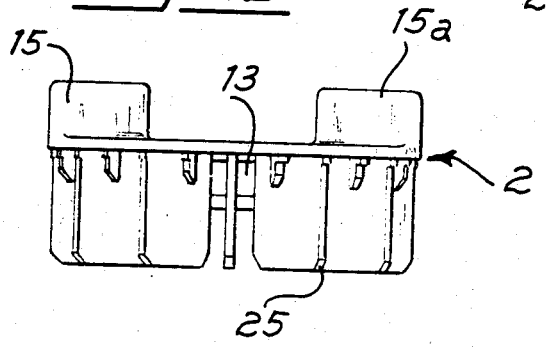
Fig. 5a
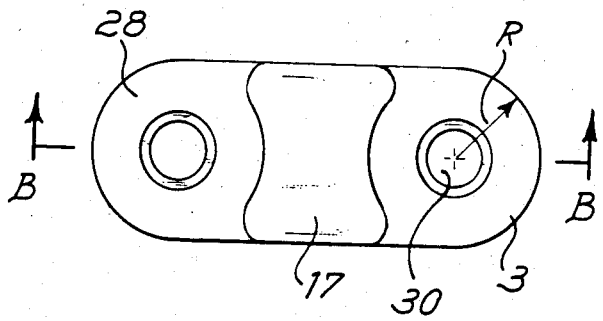
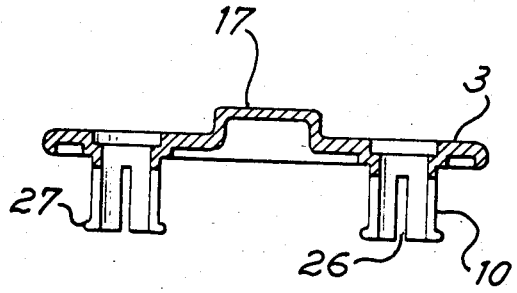
Fig. 5b

TUBULAR ELEMENTS AND JOINTS FOR THEIR MUTUAL ARTICULATED CONNECTION TO FORM A PARTITION WALL OF VARIABLE SHAPE

BACKGROUND OF THE INVENTION

The present invention relates to tubular elements and joints for their mutual articulated connection both at their upper and lower ends, to form a partition wall which is self-supporting and can be positioned so as to assume a desired curved pattern according to the requirements.

It is known that, following the present architectural trend, a so-called "open space" arrangement is adopted in the public and private offices, that is without a wall partition of the available space into separate rooms, but with the desks or each clerk's places of work being located near one another. However it is frequently required to separate certain working areas from others where a distinct and independent activity is carried on, while trying all the same to avoid permanently installed dividing structures, e.g. of masonry.

The need of modifying these separating structures in case of re-arrangement of the available space has brought to date to the use of mobile panels, such as made of laminate, which however require a supporting frame and means for the anchoring to the floor and possibly to the ceiling. Should it be necessary to modify the position of these panels, a laborious disassembly and re-assembly of the structures will be required, with consequent use of implements such as screwdrivers, wrenches, etc. It should also be appreciated the considerable cost of those partition panels and of the associate clamping means, usually made of metal as well as the limitations of varying the perimeter defined by these mobile walls which will be necessarily of the polygonal type.

SUMMARY OF THE INVENTION

It is an object of the present invention to provide a structural assembly to form a partition wall which is self-supporting and consequently does not require means for its anchoring to the floor or to the ceiling, but only junction means for mutually connecting the tubular bodies forming the assembly, all of easily mouldable plastic material, thus of low cost, which can be disassembled and re-assembled manually, without using tools.

Another important advantage of the structural assembly according to the invention resides in the possibility of placing the partition wall along the desired curved pattern to meet any various architectural requirement, being capable of immediate displacements with no need of disassembling the junction elements.

It is also possible to obtain branches of these walls, two of which can divert at an angle from a third one, thus forming e.g. a Y-shaped configuration.

BRIEF DESCRIPTION OF THE DRAWINGS

FIG. 3 shows a cross-section view of one of the upright tubular elements forming the partition wall assembly of the invention;

FIGS. 4*a*, 4*b* show respectively a view from above and a front view, the latter in the direction of arrow A, of a so-called "plug" member as used in the partition wall according to the invention;

FIGS. 5*a*, 5*b* show respectively a view from above and a sectional view along B—B of a first joining member according to the invention;

DETAILED DESCRIPTION OF THE PREFERRED EMBODIMENT

Figure 2:
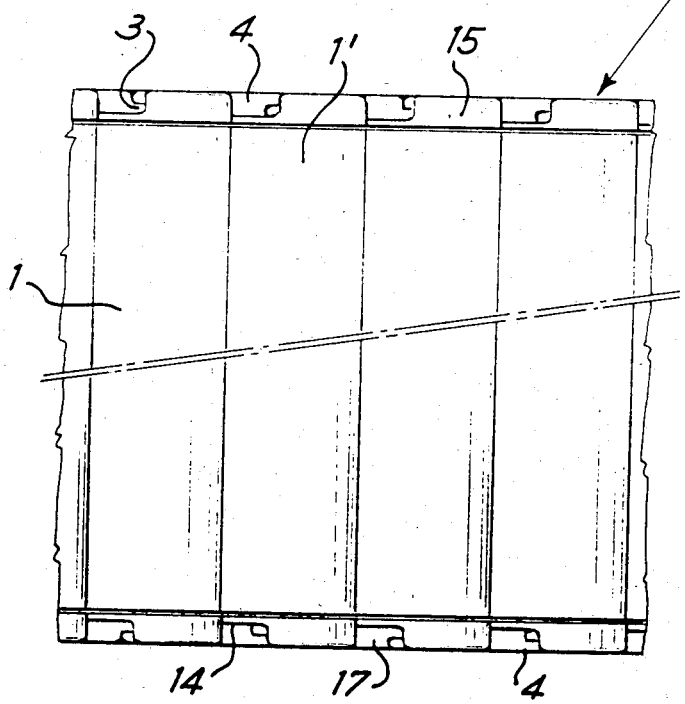
FIG. 2 shows a partial, diagrammatic front view of another embodiment of partition wall, with a sectioned particular.
Figure 6A:
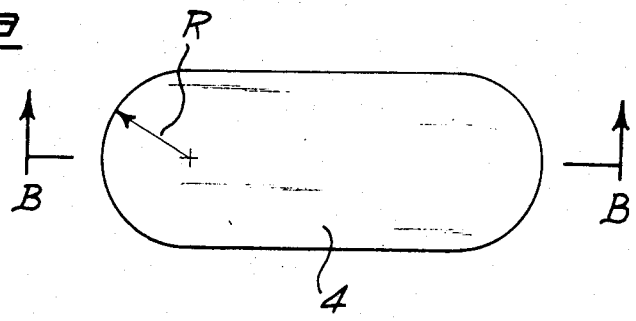
FIGS. 6*a*, 6*b* show respectively a view from above and a sectional view along B—B of a second joining member according to the invention.
Figure 6B:
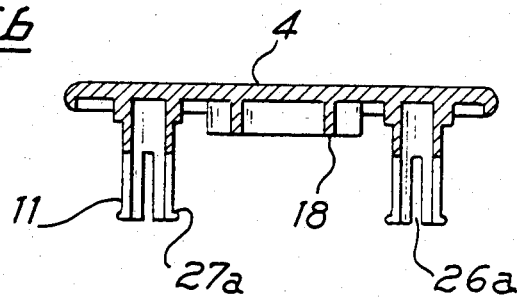

With reference to the drawings, the assembly forming the partition wall of the invention substantially comprises a plurality of tubular elements 1 placed side by side, generally cylindrical and having a cross-sectional shape as shown in FIG. 3. Each tubular element 1 is closed at both ends by a head "plug" 2, shown in FIGS. 4*a* and 4*b*, with a central hole 20 in which one of two hollow, bored pins 10 of a plate 3 can fit as well as, at the inside of pin 10, one of two joining pins 11 formed in a second link plate 4, as is better shown in the partial section of a particular of FIG. 2.

Each vertical tubular element 1 is formed in a longitudinally extending concave lateral portion 5 shaped as a circular arc in cross-section, having the same bending radius as the radius of the remainder, convex cylindrical portion 6 and is capable of rotation with such a concave portion 5 around portion 6 of the adjacent element 1'.

The distance between the axis of hole 20 and the centre of concave arc 5, corresponding to the centre of the convex portion 6 of the adjacent element 1', in other words the distance between the centres of holes 20 in plugs 2 fitted on contiguous vertical elements 1, 1' is equal to the distance between the centres of pins 10 and 11 of each link plate 3, 4, respectively.

The assembly of the structure according to the invention will now be described with a more detailed reference to the particulars of the various members by which it is composed.

The main component 1, as shown in cross-section FIG. 3 can be made of whichever light material such as aluminium, wood and preferably a resistant plastic material, having a certain elasticity and adapted to be shaped as illustrated (e.g. advantageously by extrusion), with recesses 21, 22 and 23 formed in the concave portion 5 to reinforce the structure and at the same time to impart a greater elasticity thereto. These recesses 21, 22 and 23 are symmetrically arranged to the median plane X—X of element 1 and in the represented embodiment show all an inner portion having a substantially circular cross-section which is connected to the outer periphery 5 through two facing parallel lengths of wall. The central recess 23 has a greater size than the other two recesses and extends itself to the inside of the element so that the centre of its inner circular portion coincides with the centre of the convex portion 6. The extension of portion 6 is substantially greater than the portion 5 extension. Stiffening radial ribs 24, 24*a* are provided to join said recess 23 to the inner wall of portion 6. Elements 1, 1' etc. are placed side by side so that the concave portion 5 of each of them is against the convex portion 6 of the adjacent element and so on, the mutual matching being provided by the above-indicated relationship between the respective radii.

At the upper and lower ends of each element 1 a head plug is applied as represented with 2 in FIGS. 4*a*, 4*b*. It should be appreciated that the outer profile of plug 2 is substantially coincident with that of element 1, except for recesses 21, 22, 23. The snap fitting is made easier by radial ribs 25 which not only stiffen the assembly, but also have a guide function during the coupling, as they slide with their outer ends along the inner wall of element 1. At the same time a central cylindrical bore pin 13 with through hole 20 fits along a short length at the inside of the central cylindrical passage formed by recess 23.

The plug 2 is also provided, at its upper face 14, with upraised zones 15, 15*a* being symmetrically positioned to median line X'—X', which define with their upper, co-planar surfaces a plane parallel to the surface 14 and suitable to form the base of the whole assembly, as will be explained later on. These two raised portions, as seen in FIGS. 4*a*, 4*b*, are extended from the two peripheral zones of plug 2 where the concave portion, corresponding to portion 5 of element 1, touches the convex circumferential portion corresponding to portion 6 of the element and each of them is defined in addition to these two outer zones, by a generally upright shoulder which for a length 16*a* is substantially parallel to the median line X'—X' and for a length 16 is at an acute angle therewith.

Thereafter the plugs 2, and thereby also the elements 1 already clamped to them, are connected each other in pairs by means of linking joint plates 3, 4 as respectively shown in FIGS. 5*a*, 5*b* and 6*a*, 6*b*. This occurs by fitting first in each hole 20 one pin 10 with through hole 30 of plate 3 and then, in the hole 30, one pin 11 of plate 4, the inner cavity of which is blind. The diameters of holes 20 and 30, as well as of pins 10 and 11 are so sized to allow the assembly and disassembly of the various members merely by hand, the snap fits being aided by the elastic material of the pins and by their shape with longitudinal slits 26, 26*a* and protruding edges 27, 27*a*.

The plate 3 shows in its central zone a planar raised portion 17 which is defined externally by the plate contour itself and, at the inner sides, by a shoulder with a concave profile having its bending centre coincident with the centre of hole 30 faced by said profile and a bending radius at least equal to the radius R of the rounded end 28 of plate 3. The height of the raising is such as to reach the level of raised portions 15, 15*a* when plate 3 rests with its lower surface of face 14 of plug 2 and pin 10 fitted in the hole 30.

The plate 4, on the other hand similar to plate 3 as far as the overall outline is concerned, is instead planar at its upper side and is formed with a spacing member 18 on its lower side. Spacer 18 has a profile substantially corresponding to the raising 17 and such a thickness to rest with its lower edge on the surface 14 of plug 2 when the "upper" plate 4 is fitted therein through a hole 30 of a "lower" plate 3. The overall thickness of both plates 3 and 4 in the generally circular zone where they are over lapping having the same radius R and being complementary both to the upraised portion 17 of plate 3 and to the lower spacer 18 of plate 4, is the same as the thickness of plate 3 alone in the raised portion 17, of the plate 4 alone as measured at the lower edge of spacer 18 and of the raised portions 15, 15*a* of plug 2. Thereby, upon assembly, the upper surfaces of the portions 15, 15*a*, 17 and the entire upper face of plate 4 are co-planar, so that the whole assembly can rest firmly on the floor and also the upper end has a planar profile.

It appears clearly that each element 1 (and also both the lower and upper plugs 2 associated therewith) can pivot about the adjacent element 1' faced by its concave portion 5 with a rotation axis passing through the coaxial centres of hole 20 and recess 23 and with a rotation radius corresponding to the center-to-center distance between holes 30 or pins 11.

Figure 1:
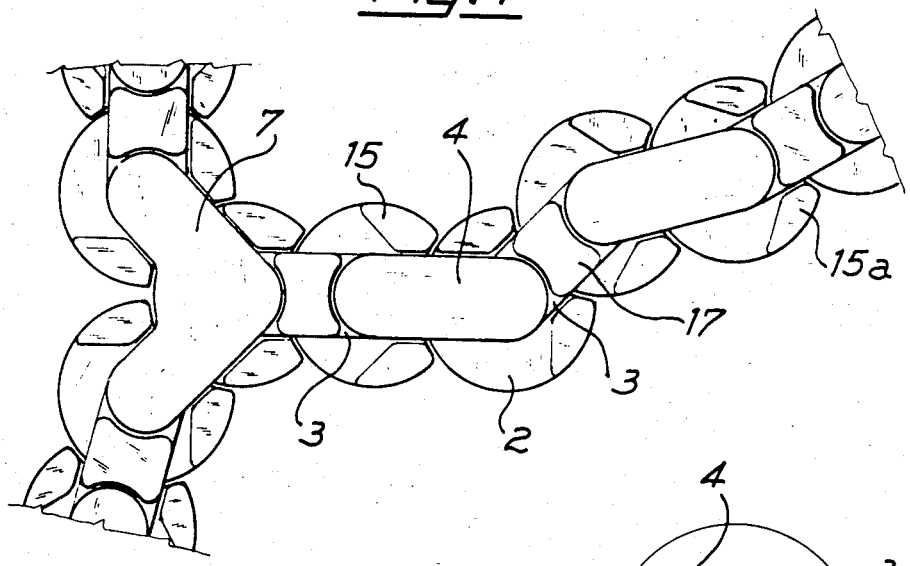
FIG. 1 shows a plan view, irrespective whether from above or from below, of a wall length according to the invention in one embodiment comprising some joints of the invention itself.
Figure 1:
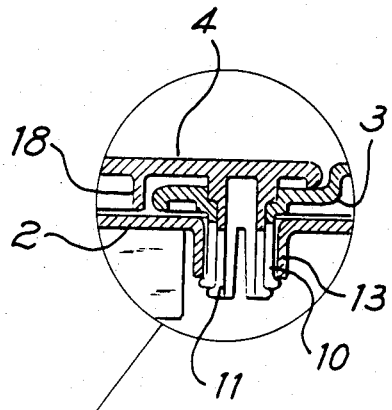

The link connection between each element 1 and the adjacent one is provided by a plate 3 and a plate 4 alternatively, as in the hole 20 of each plug 2 there are inserted every time two plates 3 and 4 respectively, directed to opposite sides, except only for the elements at the ends of the assembly. The shoulders 16, 16*a*, by which the raised portions 15, 15*a* are defined, set a limit both to the range of mutual rotation of elements, with respect to each other, and to the rotation of each element about its own axis. The two opposite shoulders 16*a* are spaced apart a distance at least corresponding to the width of a plate 3 or 4. At a limit position of maximum relative rotation of two adjacent elements, the shoulder 16 of one element is aligned with the shoulder 16*a* of the other and such a continuous shoulder forms an abutment for a side of the plate 3 or 4 involved, as shown in FIG. 1.

Figure 7:
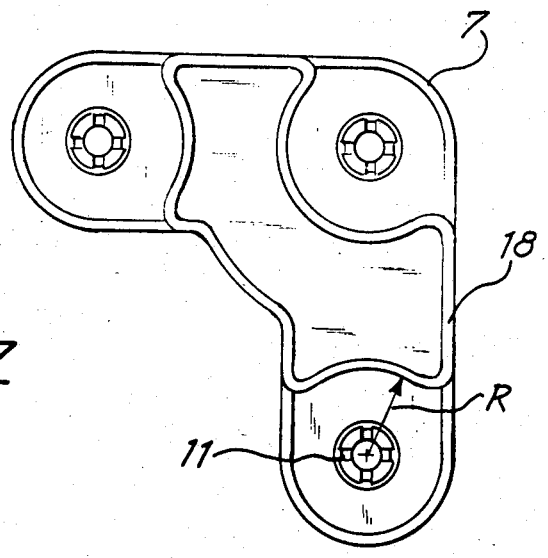
FIG. 7 shows a view below of a special embodiment of the second joining member of FIGS. 6*a* and 6*b*.

It is also provided, according to the present invention, instead of an "upper" plate 4, the use of an angular junction plate 7, substantially formed as two plates 4 integrally combined together at right angles in a L-shape with three pins 11, one at each vertex thereof, and with a lower spacer 18 having the configuration shown in FIG. 7. As indicated, the spacer 18 also in this embodiment is such as to surround, with a bending radius R, the areas designed to the rotation of the underlying associated plates 3, to form a seat for such a rotation. Plate 7 will be utilized, at the base and the top of the assembly, when a Y-shaped branching of the partition wall is desired or more commonly, at a corner when partition walls of the invention should be arranged traditionally at right angles, whereas the main characteristics of the present invention is the possibility of defining areas, by means of a single partition wall having a polygonal shape, or forming a continuous or broken curved line, substantially according to any desired pattern with the provision that no such discontinuities are involved to require a relative pivoting of two adjacent elements, for an angle greater than the range allowed by the abutments 15, 15*a*.

What I claim is:

1. Tubular elements and joints to be mutually articulately connected to form a partition wall capable of assuming a continuously variable shape which can be varied without any disassembling operation on the elements composing the same; wherein the tubular elements are generally cylindrical sections, each having a cross-section of circular shape for the major part and the remainder with a concave profile, and there is provided head plug members, each suitable to fit into the ends of said elements and having the same cross-section thereof, and said joints are elongated plates, each provided with a pair of pins adapted to fit into elements placed side by side, whereby each element can rotate with its concave portion about the convex circumferential portion of the adjacent element to vary the curved pattern of the vertical generating lines forming the wall's cylindrical configuration, the rotation radius being equal to the center-to-center distance of a pair of pins of a plate linking these two elements, each plug member having two lateral raised portions cooperable with said plates for limiting the angle range of relative rotation between two adjacent elements.

2. Elements and joints according to claim 1, wherein each plug has a central hole, and said plates comprise lower plates each having bored pins adapted to fit respectively into a central hole of a plug and upper plates each having its pins adapted to fit respectively into a through hole of a bored pin of a lower plate, the upper and lower plates extending to opposite sides from the central hole, whereby in a succession of adjacent elements said upper plates and lower plates are alternate.

3. Elements and joints according to claim 2, wherein each lower plate has an upraised portion, intermediate and symmetrical to said two through holes, and when assembled, the outer surface of upper plates, of the raised portions of the plugs and of the raised portion of lower plates are all co-planar.

4. Elements and joints according to claim 3, wherein said raised portion of said lower plate is innerly defined, at both sides, by a concave curved line facing with its concavity the respective through hole, the center of which is the bending centre of said curved line, the radius being the same or slightly greater than that of semicircular ends of the plate.

5. Elements and joints according to claim 4, wherein said upper plate has the same overall size and the same peripheral outline as the lower plate, and is provided at the lower side with a spacer member having the same shape as the raised portion of the lower plate and such a thickness as on rest with its lower edge of the plug surface upon assembly, whereby the outer face of the upper plate and said raised portion of the lower plate lie on the same plane.

6. Elements and joints according to any one of claims 2, 3, 4, or 5 wherein said hole of the plug is formed in a downwardly extending pin adapted to fit into a corresponding cylindrical passage consisting of a recess in said concave portion of the section element, there being also provided stiffening radial ribs in said element and at the lower side of said plug.

7. Elements and joints according to claim 2, wherein at least one of said joints comprises a L-shaped angular plate, substantially formed as two co-planar upper plates at right angles, combined so as to have a common end, with three pins and a spacer member which, leaves cleared three zones concentric with said three pins.

8. A partition wall formed by assembly elements and joints as claimed in any one of the preceding claims.

* * * * *